United States Patent [19]

Bowser

[11] Patent Number: 4,627,564

[45] Date of Patent: Dec. 9, 1986

[54] APPARATUS FOR FORMING A TRUSS ASSEMBLY

[75] Inventor: Donald M. Bowser, Barrie, Canada

[73] Assignee: Truswal Systems Corporation, Madison Heights, Mich.

[21] Appl. No.: 585,906

[22] Filed: Mar. 2, 1984

[51] Int. Cl.[4] ..... B27F 7/15; B27F 7/32

[52] U.S. Cl. ..... 227/152; 227/154; 269/910; 100/913

[58] Field of Search ..... 227/40, 151, 152, 154; 269/910; 100/913

[56] References Cited

U.S. PATENT DOCUMENTS

| | | | |
|---|---|---|---|
| 2,544,499 | 3/1951 | Hovey | 227/154 |
| 2,996,271 | 8/1961 | Black | 227/154 |
| 3,069,684 | 12/1962 | Moehlenpah et al. | 227/154 |
| 3,100,301 | 8/1963 | Black | 227/152 |
| 3,241,585 | 3/1966 | Jureit | 144/288 |
| 3,255,943 | 6/1966 | Sanford | 227/152 |
| 3,379,354 | 3/1968 | Moehlenpah et al. | 227/152 |
| 3,388,657 | 6/1968 | Juriet | 227/152 |
| 3,421,751 | 1/1969 | Menge | 269/305 |
| 3,593,905 | 7/1971 | Troutner | 227/152 |
| 4,002,116 | 1/1977 | Knowles | 100/100 |
| 4,084,498 | 4/1978 | Weaver | 227/152 X |
| 4,111,114 | 9/1978 | Carr | 100/100 |
| 4,379,426 | 4/1983 | Thompson et al. | 227/152 X |

FOREIGN PATENT DOCUMENTS

| | | | |
|---|---|---|---|
| 1,269,394 | 4/1972 | United Kingdom | 1,269,394 |
| 1,407,571 | 9/1975 | United Kingdom | 1,407,571 |

*Primary Examiner*—Robert L. Spruill
*Assistant Examiner*—Taylor J. Ross
*Attorney, Agent, or Firm*—Dressler, Goldsmith, Shore, Sutker & Milnamow, Ltd.

[57] ABSTRACT

An apparatus for forming a truss assembly is discussed which is particularly configured for versatility and efficiency of operation. The apparatus includes a frame which supports a pair of laterally spaced first and second support rails which receive the chords and the webs of the truss assembly being formed. A pair of pressure clamps are provided which are selectively positionable longitudinally of the apparatus frame for applying clamping pressure to nail plate connector portions of the truss assembly for joining the truss webs and chords. Notably, the apparatus includes an arrangement whereby the support rails of the apparatus can be laterally relatively moved for forming truss assemblies of varying finished heights, with the arrangement including a plurality of slide cylinder assemblies which function in the nature of double-acting fluid rams for applying a clamping pressure to this truss assembly laterally of the apparatus frame as the pressure clamps are operated for joining the elements of the truss.

15 Claims, 13 Drawing Figures

FIG. 1
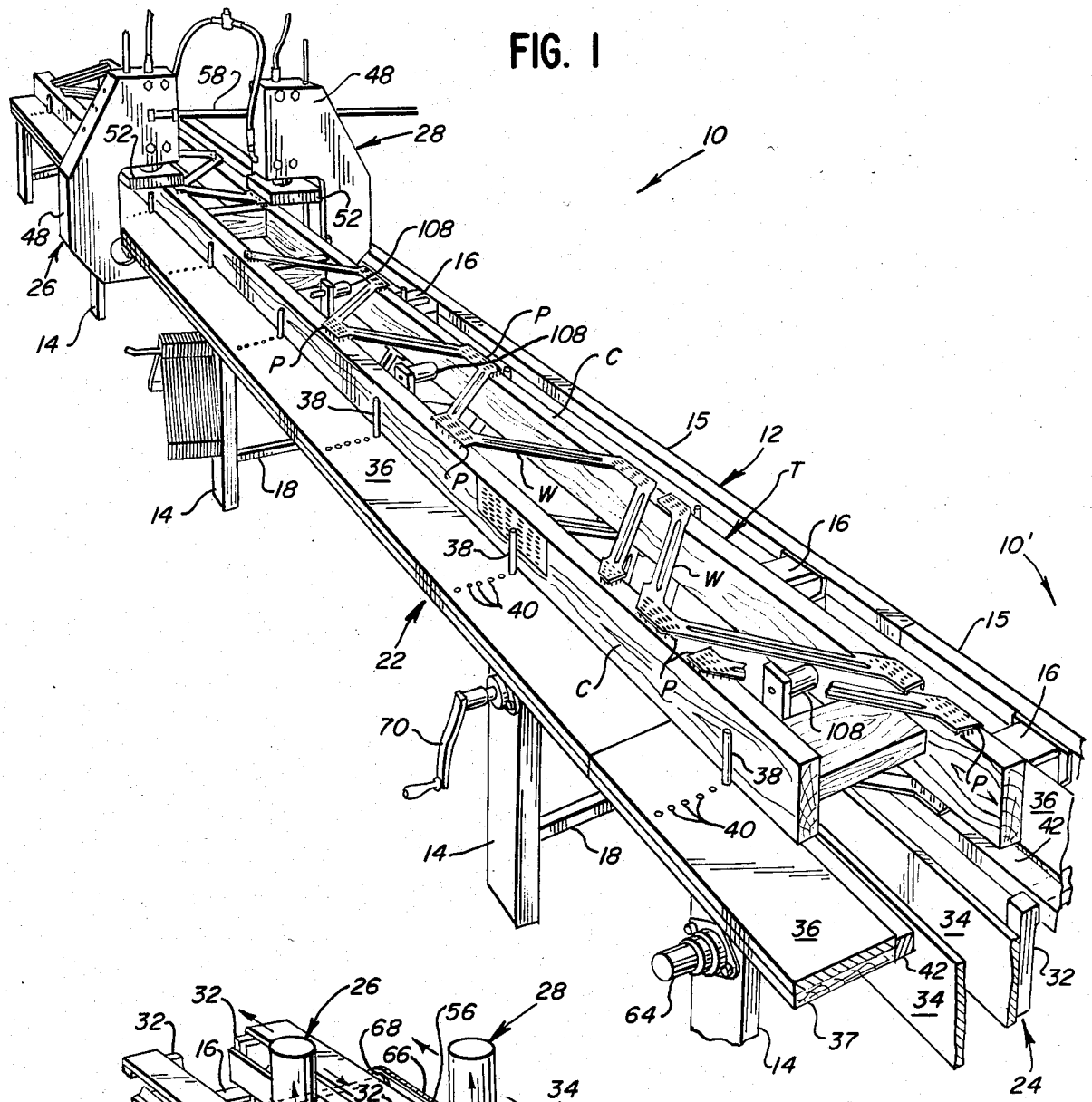
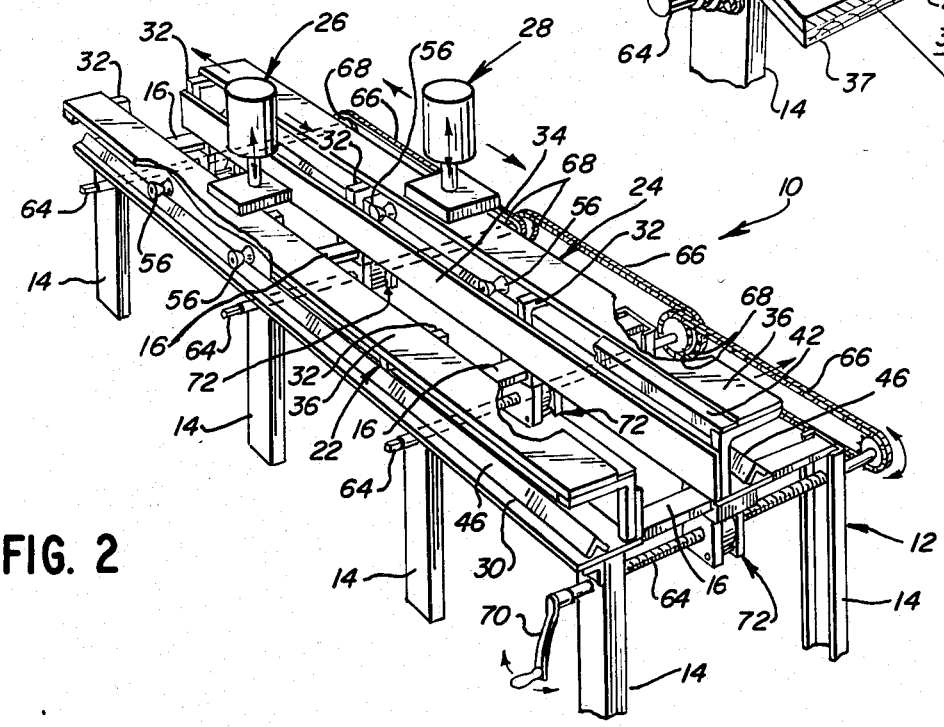
FIG. 2

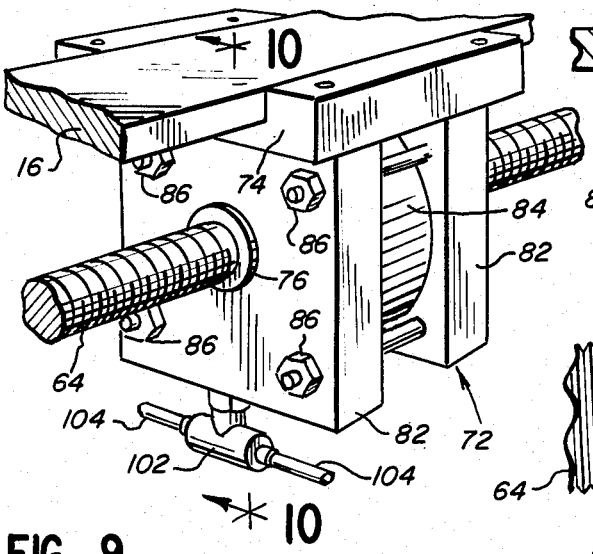
FIG. 9
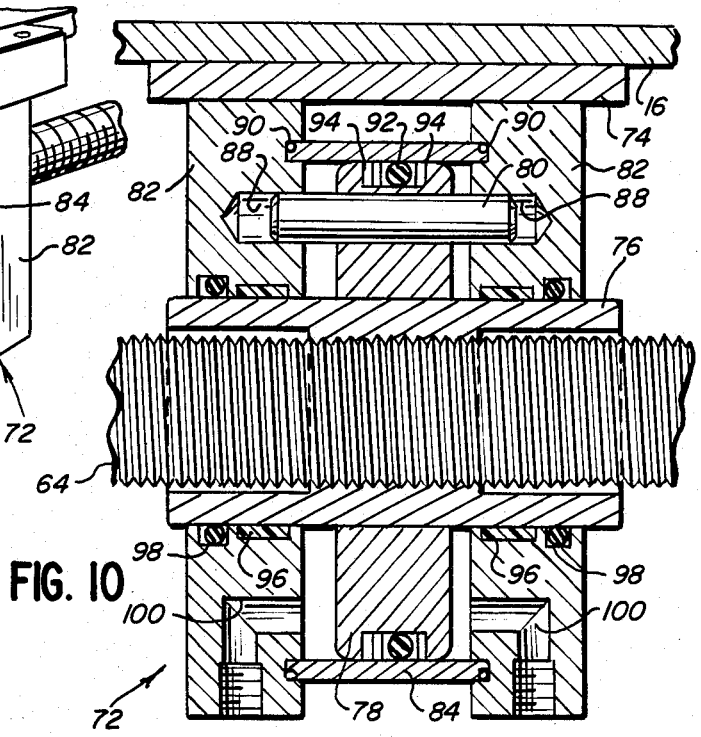
FIG. 10
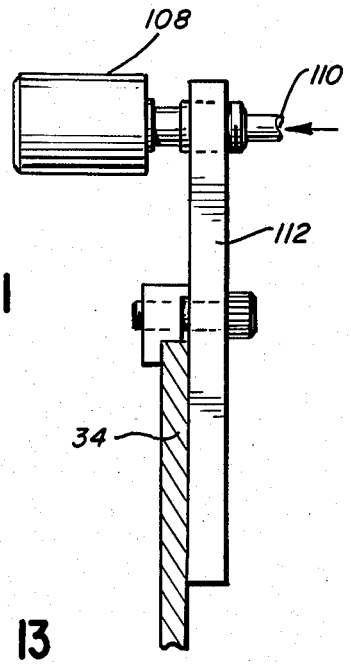
FIG. 11
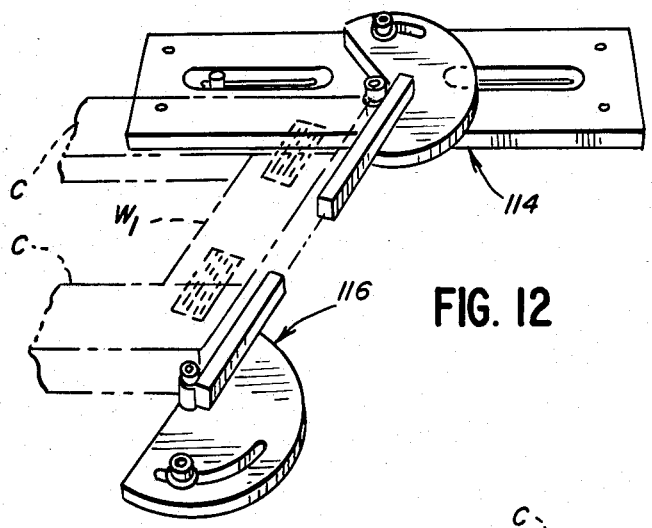
FIG. 12
FIG. 13
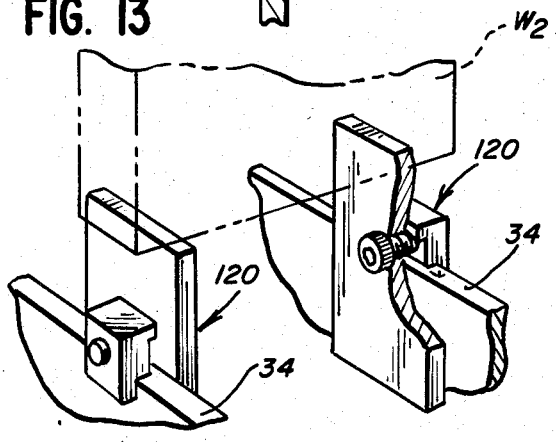
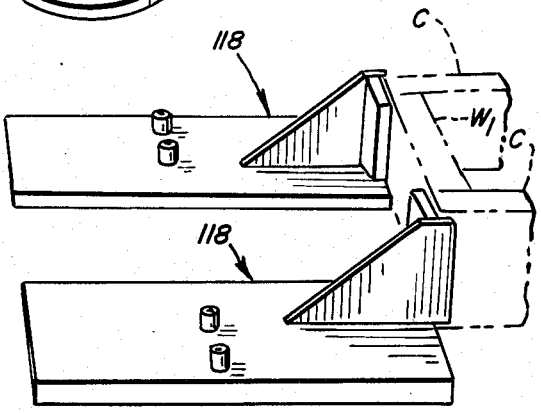

APPARATUS FOR FORMING A TRUSS ASSEMBLY

TECHNICAL FIELD

The present invention relates generally to an apparatus for forming or pre-fabricating a structural truss or joist assembly, and more particularly to a truss-forming apparatus which is readily adjustable to facilitate fabrication of truss assemblies of varying finished heights and configurations.

BACKGROUND OF THE INVENTION

The use of prefabricated structural truss and joist assemblies has become increasingly widespread in recent years in view of the highly desirable load-bearing characteristics that can be achieved with the economy of mass production. Assemblies of this nature typically include a pair of spaced-apart truss chords between which extend a plurality of truss webs. So-called nail plate arrangements are frequently employed to provide connectors for joining the truss webs to the chords, with such arrangements including a multiplicity of teeth which are embedded in the wooden elements of the truss assembly. While the truss webs of the assembly may comprises wooden elements joined to the wooden chords with nail plates or other fastening means, the truss webs may further comprise suitably formed metallic material including integral nail plates. Depending upon the desired configuration of the truss assembly, both metallic and wooden truss webs may be employed.

Prefabrication of truss assemblies is effected with the use of jig-like forming machines. Devices of this nature are arranged to facilitate the desired relative positioning of the truss chords, webs, and nail plate connector portions. After the truss elements have been arranged in the desired configuraton, the elements are joined by firmly embedding the nail plate connector portions into the wooden elements of the assembly. While the connector portions may be manually hammered into place, suitable hydraulic clamps or pressure rollers are frequently used for efficient fabrication.

Since the configuration of a truss assembly is dictated by the requirements of the structure for which it is intended, a truss-forming apparatus which facilitates efficient formation of truss assemblies of varying dimensions and configurations is particularly desirable for lending efficiency to the truss-forming process, and avoids the need for different jig arrangements for forming different trusses. At the same time, it is very desirable that a forming apparatus be arranged to hold the elements of the truss in their proper closely-fitting relation during fabrication thereof to assure the intended structural integrity and load-bearing capabilities of the assembly. In keeping with these goals, the truss-forming apparatus of the present invention has been specifically configured for highly versatile use in efficiently forming truss assemblies of varying dimensions and configurations, and at the same time is arranged to position and maintain the elements of the truss in closely-fitting relation during its fabrication.

SUMMARY OF THE INVENTION

An apparatus for forming a truss assembly embodying the principles of the present invention is disclosed which is arranged for highly versatile and efficient operation. The apparatus includes an arrangement for very conveniently adjusting the apparatus to permit fabrication of truss assemblies of varying finished heights or "depths", and further includes a number of selectively positionable jig-like elements for positioning and maintaining the elements of the truss assembly in their desired relative orientations. Notably, the arrangement for adjusting the apparatus is preferably configured such that the chords of the truss assembly can be urged together during fabrication with the selective use of fluid pressure. In this manner, the elements of the assembly are maintained in close-fitting relation as the nail plate connector portions are embedded in the wooden elements of the truss.

The present apparatus comprises a suitable frame which supports a pair of first and second laterally spaced support rails. The support rails are supported in generally parallel relation for receiving the chords and the webs of the truss assembly to be fabricated. To this end, the support rails are particularly configured to permit them to receive truss chord elements of various dimensions, with a plurality of fluid pressure rams preferably provided which are selectively positionable on the support rails for holding the chord elements in position thereon. Web-positioning jigs are also provided which are selectively positionable on the support rails to further facilitate the assembly of the truss elements.

In keeping with the desired goals of the present invention, the present apparatus includes means mounting the first and second support rails for relative lateral movement with respect to each other. In the illustrated embodiment, the desired relative lateral movement is achieved by the mounting of the second support rail for laterally slidable movement with respect to the apparatus frame. The slidable mounting of this support rail not only provides the desired adjustability of the apparatus, but also facilitates movement of the support rails toward each other during truss fabrication with a clamp-like locking action.

The present apparatus further includes an arrangement for very conveniently effecting the relative lateral movement of the first and second support rails. In the preferred form, the movement effecting means comprises means for moving the second support rail laterally of the frame to facilitate forming of truss assemblies of varying finished heights, and further includes means for urging the support rails toward each other during forming of the truss assembly. This aspect of the construction includes first screw thread means mounted on one of the frame and the second support rail, second screw thread means mounted on the other of the frame and the second support rail, and means for relatively rotating the first and second screw thread means.

In the illustrated embodiment, the first screw thread means comprises a plurality of spaced threaded shafts rotatably mounted on and extending laterally of the apparatus frame. The second screw thread means comprises a plurality of threaded sleeves which are respectively disposed on the threaded shafts, with the threaded sleeves mounted on the second support rail. A chain and sprocket arrangement is provided for interconnecting the threaded shafts for concurrent rotation, with a suitable hand crank provided for imparting concurrent rotation to the shafts. In this manner, the second support rail can be very conveniently and easily moved laterally of the frame for adjusting the apparatus.

In order to provide the desired clamp-like action of the first and second support rails by relative movement toward each other during truss fabrication, the threaded sleeves are mounted on the second support rail by respective slide cylinder assemblies which are in the nature of double-acting fluid rams. By this arrangement, selective fluid pressurization, preferably pneumatic, of the slide cylinder assemblies acts to shift the second support rail laterally of the threaded sleeves mounted thereon. The lateral clamping pressure which is provided by the slide cylinder assemblies is effected as the elements of the truss assembly are assembled in position, and prior to joining of the elements with the nail plate connector portions. Thus, the elements of the assembly are maintained in closely-fitting relating as the elements are permanently joined with the connector portions.

In the preferred form, the present apparatus includes first and second pressure clamps which are mounted on the apparatus frame for selective positioning longitudinally of the frame. In the illustrated embodiment, the pressure clamps are mounted on tracks positioned on the first and second support rails, with the second pressure clamp adapted for movement laterally of the frame together with the second support rail. To this end, the pressure clamps are connected together by an offset link which maintains the pressure clamps in offset relation for movement longitudinally of the apparatus, with the offset link arrangement including a linear bearing to facilitate movement of the second pressure clamp with the second support rail laterally of the frame.

The first and second support rails preferably each include a vertically movable or "floating" platen for coaction with the respective one of the pressure clamps. By this construction, clamping pressure is exerted on the nail plate connector portions of the assembly in a highly positive manner, with substantially equal clamping pressure applied to the connector portions disposed above and below the truss chords.

Numerous other features and advantages of the present invention will become readily apparent from the following detailed description, the accompanying drawings, and the appended claims.

BRIEF DESCRIPTION OF THE DRAWINGS

FIG. 1 is a perspective view of an apparatus for forming a truss assembly embodying the principles of the present invention, with the apparatus being shown in use with a like apparatus;

FIG. 2 is a diagrammatic, perspective view of the apparatus shown in FIG. 1;

FIG. 9 is a perspective view of a slide cylinder assembly for effecting lateral movement of one of the support rails of the present apparatus;

FIG. 10 is a cross-sectional view of the slide cylinder assembly shown in FIG. 9 taken generally along lines 10—10 of FIG. 9;

FIG. 11 is a side elevational view of a fluid ram which is selectively positionable on the support rails of the present apparatus for holding the truss chords in position thereon;

FIG. 12 illustrates perspective views of two different end jig arrangements for holding elements of a truss assembly in position for fabrication; and FIG. 13 is a perspective view in partial cutaway illustrating a pair of web-positioning jigs for positioning web elements of the truss assembly during fabrication.

DETAILED DESCRIPTION

Figure 3:
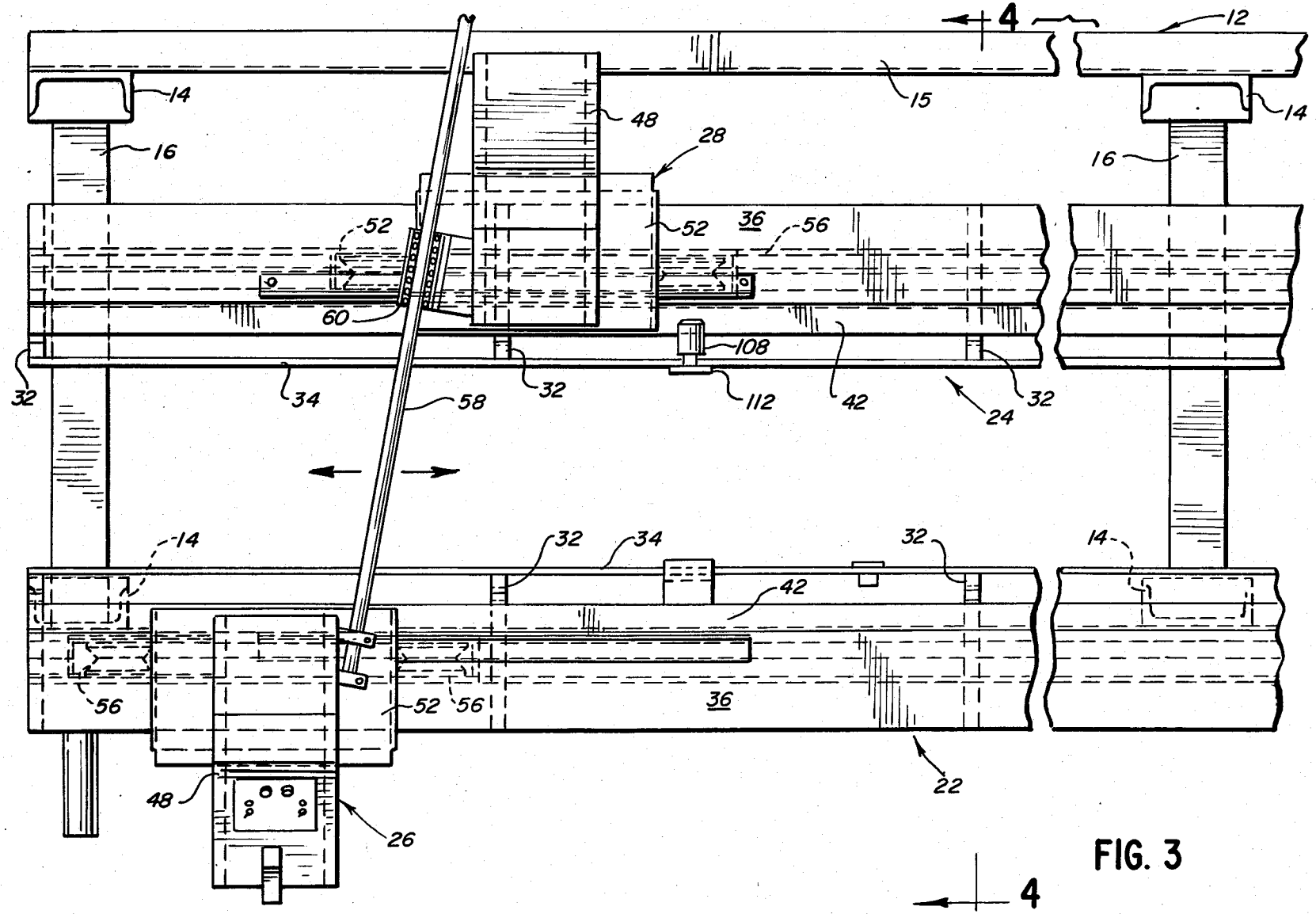
FIG. 3 is a top plan view of one end of the present truss-forming apparatus.

While the present invention is susceptible of embodiment in various forms, there is shown in the drawings and will hereinafter be described a presently preferred embodiment, with the understanding the present disclosure is to be considered as an exemplification of the invention, and is not intended to limit the invention to the specific embodiment illustrated.

With reference now to the drawings, therein is illustrated an apparatus 10 for forming a truss assembly, generally designated T, embodying the principles of the present invention. While truss T may be formed in a wide variety of differing configurations, the truss is typically illustrated as including a pair of spaced-apart, parallel truss chords C between which extend a plurality of truss webs W joined to the chords C with nail plate connector portions P. As will be observed in FIG. 1, the truss webs W may be of metallic construction wherein the connector portions P are integrally formed therewith. Webs of wooden material may likewise be employed, with separate nail plate connector portions P positioned along the chords C for joining the chords and the webs.

Figure 6:
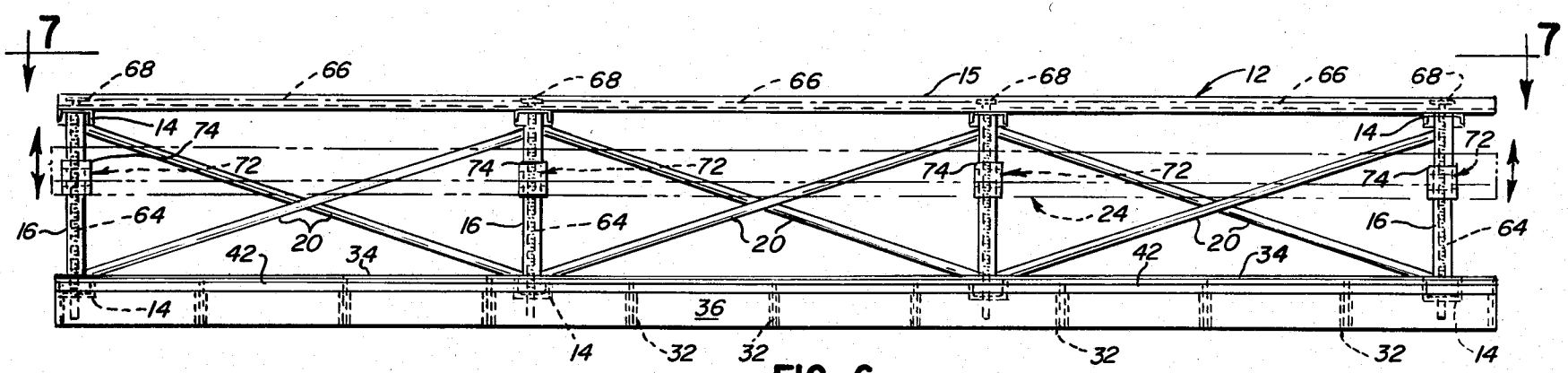
FIG. 6 is a top plan view of selected portions of the present apparatus, shown in partial phantom line for clarity.
Figure 8:
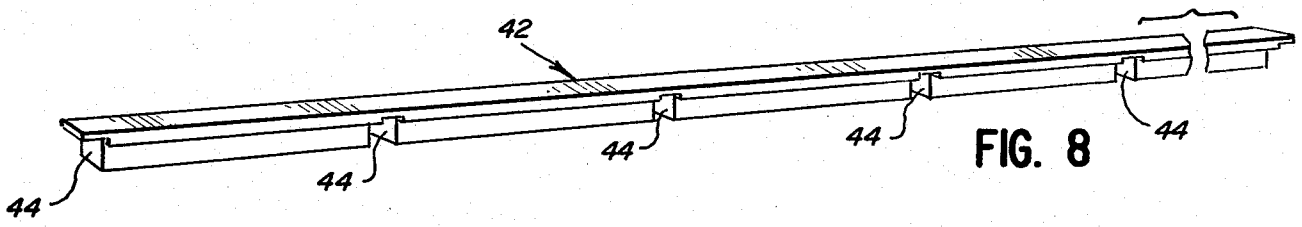
FIG. 8 is a perspective view of a vertically movable platen provided in each of two support rails of the present apparatus.

Apparatus 10 includes a frame 12 including a plurality of vertical legs 14 to facilitate convenient positioning of the truss elements on the apparatus for truss fabrication. A plurality of spaced, laterally extending upper cross-frame members 16 extend between respective lateral pairs of the frame legs 14, with a pair of side frame members 15, illustrated as comprising angle members, extending longitudinally along the laterally opposite sides of the frame. A plurality of lower cross-frame members 18 and diagonal braces 20 (FIG. 6) lend desired rigidity and strength to the frame.

The embodiment of apparatus 10 illustrated in the drawings is formed as a unit having a length of approximately twenty feet. Therefore, fabrication of trusses of greater lengths is readily achieved by aligning two or more of the apparatuses in end-to-end relation for use together, such as illustrated in FIG. 1 wherein a portion of a like apparatus 10' is shown being operated in conjunction with the apparatus 10.

In accordance with the present invention, apparatus 10 includes first and second support rails 22 and 24 which are supported on frame 12 in generally parallel relation. As will be further described, the present apparatus is configured to permit relative lateral movement of the support rails 22 and 24, and to this end, second support rail 24 is slidably mounted on upper cross-frame members 16.

In order to apply clamping pressure to the connector portions P of the truss being formed for joining chords C and webs W, first and second pressure clamps 26 and 28 are mounted on frame 12 for selective positioning longitudinally thereof. As will also be further described, each of the pressure clamps preferably includes a hydraulic fluid ram whereby the connector portions P of the truss can be embedded in wooden truss elements by selective positioning of the pressure clamps 26 and 28 along the apparatus frame.

Figure 4:
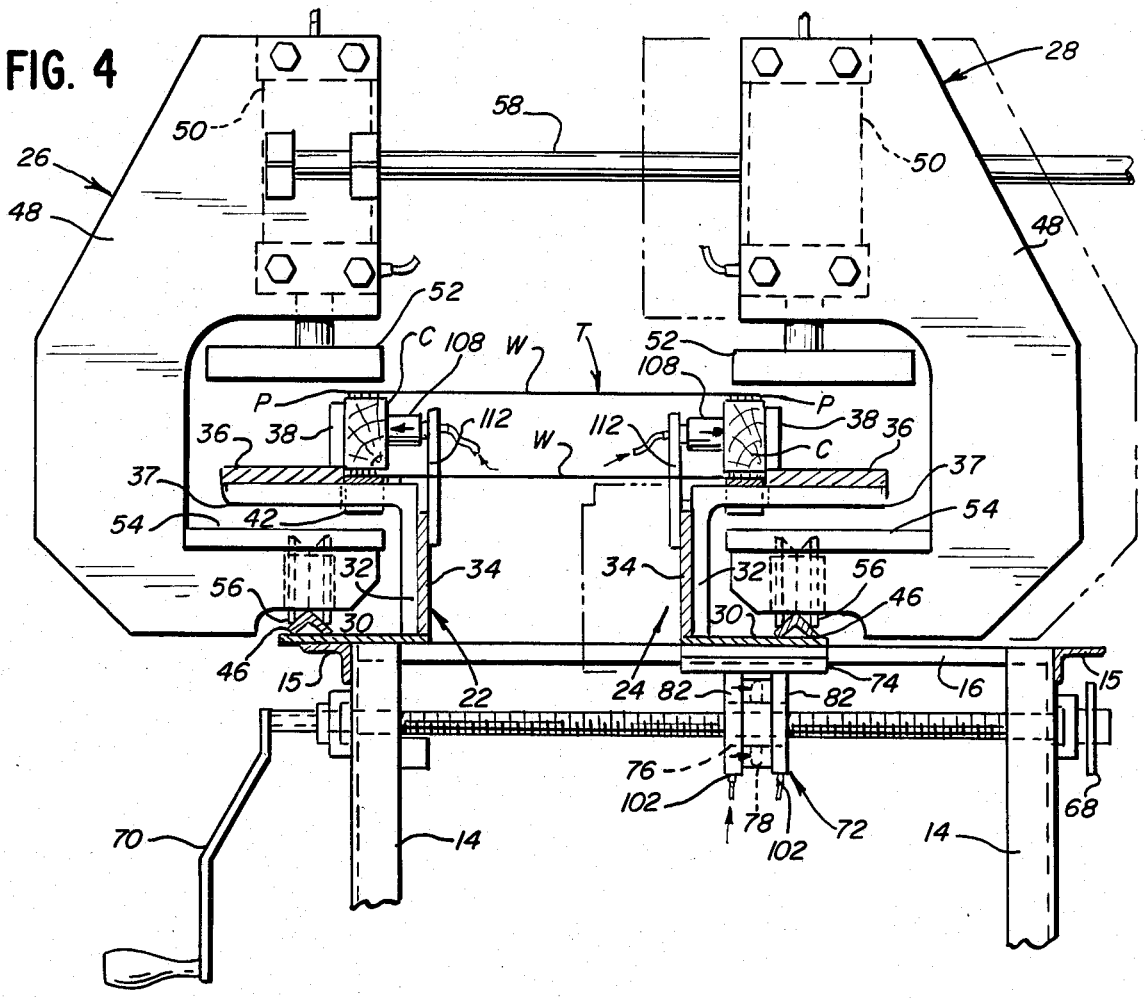
FIG. 4 is view taken generally along lines 4—4 of FIG. 3 illustrating operation of the present apparatus.

With particular reference to FIGS. 1, 2, and 4, it will be observed that the first and second support rails 22 and 24 are of like configuration as will now be described. Each support rail includes a lower plate 30, with the plate 30 of first support rail 22 affixed to apparatus frame 12 generally at one lateral edge thereof, and with the lower plate 30 of second support rail 24 slidably supported by upper cross-frame members 16.

Each of the support rails 22 and 24 further includes a plurality of longitudinally spaced, generally L-shaped supports 32 which extend upwardly from the lower support rail plates 30. Each support rail further includes a vertical inner plate 34 affixed to the vertical legs of the respective supports 32, and an upper horizontal plate 36 affixed to the respective horizontal legs of the supports 32. Spacer plates 37, preferably comprising plywood or a like material exhibiting some compressibility, are affixed to the lower surfaces of upper plates 36 between the L-shaped supports 32. The provision of spacer plates 37 desirably provides a cushioning effect during application of clamping pressure with clamps 26 and 28 and acts to give a more positive clamping action on connector positions P than with unyielding steel spacer surfaces.

As best shown in FIG. 1, each upper plate 36 of the support rails 22 and 24 is preferably provided with a plurality of chord support pegs 38 which are selectively positionable in a plurality of laterally aligned peg holes 40. By this construction, the support rails 22 and 24 can be very easily adjusted for receiving truss chords C of different sizes, with the vertical dimension of support pegs 38 selected to avoid interference with pressure clamps 26 and 28 during operation of the clamps.

Figure 7:
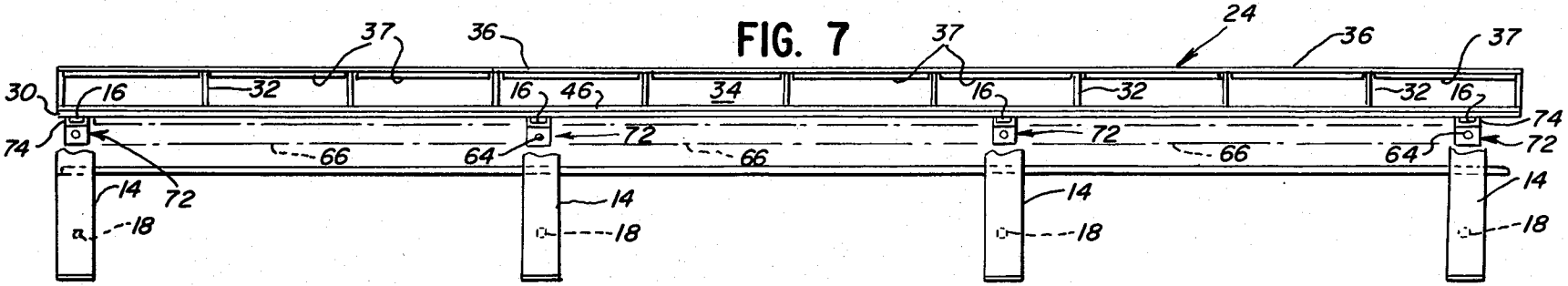
FIG. 7 is a view taken generally lines 7—7 of FIG. 6.

In order to facilitate the application of clamping pressure to connector portions P of the truss assembly positioned above and below its spaced chords C, each of the support rails 22 and 24 includes an elongated, vertically movable or "floating" platen 42. As best shown in FIG. 7, each platen 42 defines a plurality of notches 44 such that each platen 42 is positionable upon the L-shaped supports 32 of its respective support rail just inwardly of upper support rail plate 36, and preferably just below the upper surface of the plate 36 so that a "lip" is defined at the edge of the plate 36 to facilitate convenient positioning of the truss elements on the support rails, and to help prevent movement of the elements out of their proper positions. The vertically movable platens 42 are dimensioned so as to extend below the horizontal legs of the L-shaped supports 32 for effecting application of clamping pressure to connector portions P below truss chords C by the first and second pressure clamps 26 and 28. This feature of the construction has been found to provide a highly desirable clamping action since if permits "equilization" of the clamping pressure that is applied on opposite sides of the truss chords C, thus resulting in the teeth of the nail plate connector portions P being set equally from opposite sides of the chords.

Figure 5:
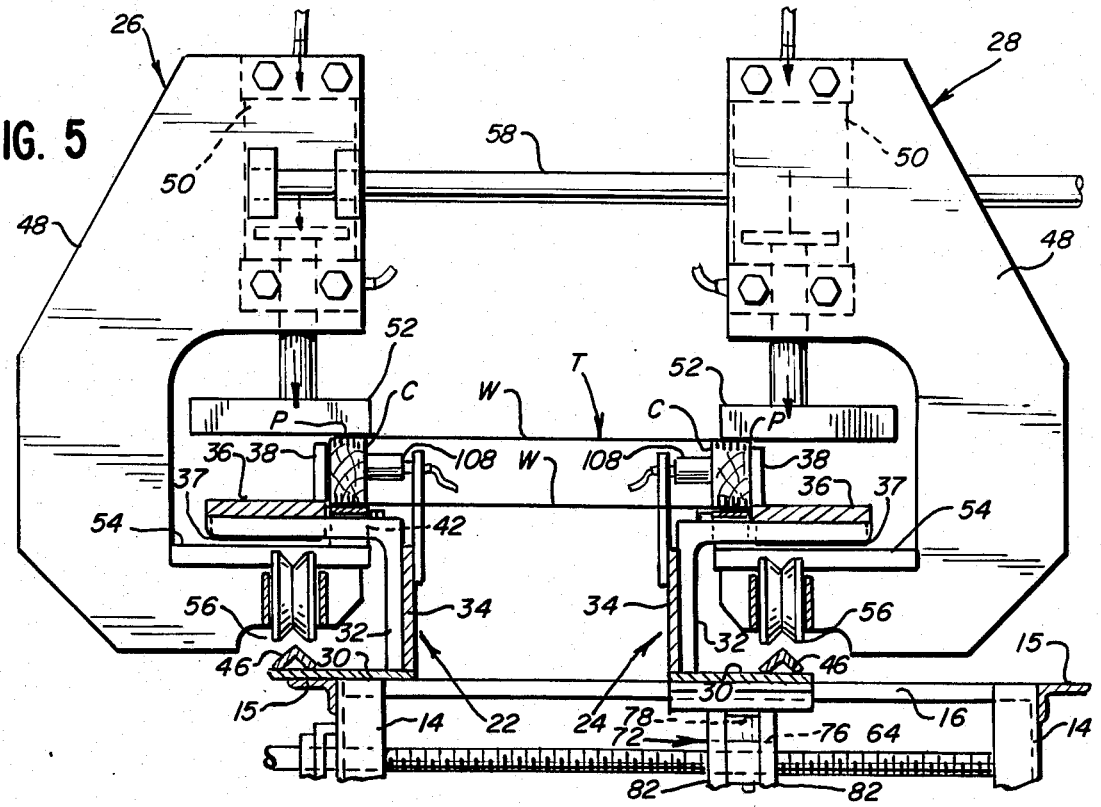
FIG. 5 is a view similar to FIG. 4 further illustrating operation of the present apparatus.

With particular reference to FIGS. 3, 4, and 5, the preferred configuration of the pressure clamps 26 and 28 will now be described. As will be observed, each of the first and second support rails 22 and 24 includes a clamp track 46 positioned on its respective lower plate 30 for rollingly supporting the pressure clamps 26 and 28 for selective positioning longitudinally of the apparatus frame 12. Each of the pressure clamps is of essentially like configuration, with each preferably including a generally C-shaped frame 48 of suitably welded plate construction. Each pressure clamp further includes a fluid-operated ram 50 which is preferably in the nature of a double-acting hydraulic cylinder, but which may alternately comprise a single-acting cylinder operatively associated with suitable biasing springs for effecting a return stroke.

The fluid rams 50 provide clamping pressure for joining the truss elements with connector portions P with upper and lower clamp plates 52 and 54. The upper clamp plates 52 are respectively affixed to the piston rods of the fluid rams 50, with the lower clamp plates 54 respectively mounted on the C-shaped clamp frames 48 such that each pair of upper and lower clamp plates are respectively disposed above and below the upper plates 36 and spacer plates 37 of the respective first and second support rails 22 and 24. The surfaces of the clamp plates are preferably slightly angled with respect to each other (i.e., the surfaces taper away from each other from the inner edges to the outer edges) so that the plates are parallel when the C-shaped frames 48 deform or flex during application of clamping pressure to truss T. Each of the pressure clamps 26 and 28 includes a pair of longitudinally spaced wheels 46 whereby the pressure clamps can be readily selectively positioned along apparatus frame 12 by movement along the respective tracks 46 of the first and second support rails 22 and 24.

FIGS. 4 and 5 illustrate operation of the pressure clamps 26 and 28 for joining the elements of the truss T. FIG. 4 shows the elements of the truss T in position to be joined, with the integral connector portions P of the truss web W positioned above and below the pair of truss chords C. It should be noted that platens 42 of the support rails 22 and 24 are preferably configured such that truss chords C are positionable thereon adjacent the edges of the upper plates 36 in generally abutting relation with support pegs 38 when the chords C are of the commonly used "two-by-four" or "two-by-six" (inches) configuration and are positioned "on edge" in the apparatus.

FIG. 5 illustrates the application of clamping pressure to the connector portions P by pressure clamps 26 and 28 by operation of fluid rams 50. As will be observed, the vertically movable platens 42 of the first and second support rails 22 and 24 coact with the lower clamp plates 54 of the pressure clamps so that clamping pressure is substantially equally applied to the upper and lower sides of each truss chord C by the clamp plates 52 and 54. By this arrangement, a very positive clamping pressure is applied to the truss nail plate connector portions. It will be observed that during application of clamping pressure, the pressure clamps 26 and 28 raise themselves off of their respective tracks 46, with the complementary V-shaped configuration of the tracks 46 and the clamp wheels 56 desirably providing a self-aligning action to assure that the pressure clamps 26 and 28 return to their rolling disposition on the tracks 46 when clamping pressure is released.

As best shown in FIGS. 1 and 3, it is preferred that the first and second pressure clamps 26 and 28 be movable together longitudinally of apparatus frame 12 while they are maintained in offset relation. This arrangement is preferred since it permits simultaneous operation of the pressure clamps for applying clamping pressure to the typically offset connector portions P of the truss assembly T. To this end, an offset link 58 connects the first and second pressure clamps 26 and 28. Notably, link 58 is fixedly joined to pressure clamp 26, but is joined to pressure 28 with a linear bearing 60. This arrangement acts to maintain the pressure clamps in predetermined offset relation, while permitting movement of second pressure clamp 28 laterally of apparatus frame 12 together with its respective second support rail 24.

The arrangement for effecting lateral movement of second support rail 24 and second pressure clamp 28 will now be described.

As shown in FIGS. 4 to 7, and as diagramatically illustrated in FIG. 2, apparatus 10 includes a plurality of longitudinally spaced, laterally extending threaded shafts 64 (four being shown) rotatably mounted on legs 14 of apparatus frame 12 with suitable bearings. A plurality of roller chains 66 and sprockets 68 operatively interconnect the threaded shafts 64 for concurrent rotation together in the same direction of rotation. A hand crank 70 is mounted on one of the threaded shafts 64 and permits the operator of the apparatus to impart concurrent rotation to all of the shafts 64 by appropriate manipulation of the crank 70.

In order for concurrent rotation of threaded shafts 64 to effect lateral movement of the second support rail 24 with respect to the apparatus frame 12 for adjusting the apparatus, the apparatus further includes a plurality of slide cylinder assemblies, each designated 72, respectively mounted on threaded shafts 64, with each assembly 72 further mounted on and affixed to the second support rail 24. To this end, each slide cylinder assembly 72 is affixed to a respective retaining plate 74 positioned generally beneath a respective one of upper cross-frame members 16. Each retaining plate 74 is in turn connected to lower plate 30 of second support rail 24, with the arrangement thus configured to permit sliding lateral movement of second support rail 24 upon the upper cross-frame members 16.

With particular reference to FIGS. 9 and 10, it is to be appreciated that each of the slide cylinder assemblies 72 is in the nature of a double-acting fluid ram. By this construction, adjustable positioning of second support rail 24 laterally of frame 12 is readily effected depending upon the finished height of the truss assembly to be formed, with the slide cylinder assemblies 72 thereafter being suitably pressurized with fluid (air) whereby the second support rail 24 is urged toward the first support rail 22 to provide a clamping action which maintains the elements of the truss assembly in closely-fitting relation during operation of pressure clamps 26 and 28 for applying clamping pressure to connector portions P of the truss.

Each slide cylinder assembly 72 includes a threaded sleeve 76 which threadingly engages a respective one of the threaded shafts 64. Each threaded sleeve 76 is held against rotation with its respective shaft 64 such that rotation of the shaft 64 imparts lateral movement to the threaded sleeve 76, and thus to second support rail 24 through retaining plate 74.

In order for the slide cylinder assemblies 72 to provide the desired selective clamping action, each assembly includes a preferably circular fluid piston 78 affixed to the respective threaded sleeve 76. In a current embodiment, the fluid piston 78 is provided with an outside diameter of approximately 3.25 inches, an inside diameter (at sleeve 76) of approximately 1.5 inches, and an effective relative stroke of approximately 0.38 inches. A pin 80 is provided which extends through and is affixed to the fluid piston 78, with the ends of the pin 80 in turn slidably received within a pair of spaced end plates 82 of the assembly 72.

Each assembly 72 further includes a cylinder 84 which extends between the end plates 82, and which together with the end plates provides a fluid cylinder assembly within which the fluid piston 78 is relatively reciprocably movable. A plurality of mechanical fasteners 86 (FIG. 9) extend through the end plates 82 to retain the elements together. End plates 82 repectively define pin bores 88 within which pin 80 is relatively slidable, with static O-rings 90 provided at the interface of the end plates 82 with the cylinder 84 to provide a fluid-tight seal.

As will be appreciated by the elements of the slide cylinder assemblies 72 thus far described, each assembly, in essence, includes a pair of fluid pressure chambers on opposite sides of the fluid piston 78. Accordingly, selective fluid pressurization of one side of fluid piston 78 or the other effects shifting of the end plates 82 and the cylinder 84 with respect to the threaded sleeve 76 in the fluid piston 78, thus permitting the second support rail 24 to be selectively shifted with respect to the plurality of threaded sleeves 76 mounted thereon by the respective slide cylinder assemblies 72 and the retaining plates 74. A working action in this manner is facilitated by the provision of a dynamic O-ring 92 at the interface of fluid piston 78 and cylinder 84, with the O-ring 92 flanked by a pair of back-up rings 94. Relative movement of the end plates 82 with respect to the threaded sleeve 76 is accommodated by the provision of a pair of bearing elements 96 respectively positioned in the end plates 82, with a pair of dynamic O-rings 98 further preferably provided to accommodate movement of end plates 82 with respect to the threaded sleeve 76 while maintaining fluid pressure within the chambers provided on the opposite sides of the fluid piston 78.

With further reference to FIGS. 9 and 10, each of the end plates 82 defines an air port 100 respectively opening into the fluid chambers provided on opposite sides of the fluid piston 78. Each air port 100 receives a suitable air hose fitting 102 connected with suitable air hoses 104. As will be recognized, the slide cylinder assemblies 72 of apparatus 10 are intended to provide the desired clamping action of the truss being assembled by operation in concert with each other, and thus the fluid chambers provided on one side of the respective fluid piston 78 may be joined in fluid communication for operation together, and likewise the chambers provided on the opposite side of the fluid pistons 78 may be joined together.

Before further describing the operation of the slide cylinder assemblies 72, it should be noted that the apparatus 10 is preferably provided with a plurality of selectively positionable chord-holding pneumatic fluid rams 108. The rams 108 are preferably in the nature of single-acting pneumatic cylinders, and are configured to be pressurized with fluid via respective air inlets 110 in order to hold and clamp truss chords C in position on first and second support rails 22 and 24 against their respective support pegs 38. Each of the fluid rams 108 is mounted on a respective positioning bracket 112 which is configured for selective positioning along the vertical inner plate 34 of each of the first and second support rails 22 and 24. The releasable mounting of each of the fluid rams 108, as well as the illustrated configuration of the support rails 22 and 24, permits the rams 108 to be readily positioned as needed along the lengths of the first and second support rails 22 and 24 for firmly holding truss chords C in position thereon, and for straightening any minor irregularities in the chords.

The operation of chord-holding fluid rams 108 and slide cylinder assemblies 72 is illustrated in FIGS. 4 and 5. FIG. 4 illustrates the elements of truss C in position for application of clamping pressure to connector portions P by first and second pressure clamps 26 and 28. After the lower webs W have been positioned on platens 42 of the support rails 22 and 24, chords C are next put into position, and chord-holding rams 108 are pressurized so as to urge and firmly hold the truss chords C against the support pegs 38 of the respective support rails 22 and 24. The slide cylinder assemblies 72 are next selectively pressurized such that the second support rail 24 is shifted laterally with respect to the threaded sleeves 76 mounted thereon and is urged toward the first support rail 22. This lateral clamping action on the truss assembly is maintained as the upper ones of truss webs W are positioned on chords C and clamping pressure is applied to the truss connector portions P by first and second pressure clamps 26. After operation of pressure clamps 26 and 28 along the length of apparatus 10 for applying clamping pressure to all of the connector portions P of the truss assembly, fluid pressure in chord-holding rams 108 is relieved, and the opposite sides of the fluid pistons 78 of the slide cylinder assemblies 72 are pressurized to shift second support rail 24 away from first support rail 22 to permit the finished truss assembly to be removed from the apparatus.

Several additional features of the present apparatus should be noted since they further enhance its versatility for fabrication of trusses of many different configurations. As best shown in FIG. 12, web-positioning end jigs may be readily mounted on the upper plates 36 of the first and second support rails 22 and 24 with the holes 40 in the plates 36 for holding an endmost one of the truss webs, designated $W_1$, in its correct position for truss formation. When the endmost truss web is disposed at an angle, end jigs 114 and 116 can be employed for maintaining the web in position, with each of the jigs 114 and 116 configured for holding the endmost web in any of a plurality of angular orientations. As further shown in FIG. 12, a pair of end jigs 118 can be similarly employed for maintaining an endmost web $W_1$ in position with the truss chords C when a "square" truss end is to be formed. Again, the end jigs such as 114, 116, 118 are configured for selective positioning on the support rails 22 and 24 as may be required.

FIG. 13 illustrates a pair of web positioning jigs 120 for maintaining an intermediate truss web, designated $W_2$, in position for truss formation. The jigs 120 are configured for selective positioning along vertical inner plate 34 of each of the support rails 22 and 24, and may be employed for supporting a web $W_2$ such as shown in FIG. 13, and can also be employed for facilitating correct positioning of metallic webs such as W including integral connector portions P. The provision of a plurality of selectively positionable jigs such as 120 permits the elements of the truss assembly being formed to be very conveniently and efficiently positioned for subsequent joining with pressure clamps 26 and 28.

From the foregoing description of the present apparatus, its highly versatile nature will be readily appreciated. The adjustable positioning of the second support rail 24 readily accommodates formation of truss or joist assemblies of varying finished heights, with the adjustably positionable nature of support pegs 38 permitting truss chords of various dimensions to be employed. Further versatility is achieved by the provision of selectively positionable chord-holding fluid rams 108, as well as positioning jigs such as 114, 116, 118, and 120.

From the foregoing, it will be observed that numerous modifications and variations may be effected without departing from the true spirit and scope of the novel concept of the present invention. It will be understood that no limitation with respect to the specific apparatus disclosed herein is intended or should be inferred. It is, of course, intended to cover by the appended claims all such modifications as fall within the scope of the claims.

What is claimed is:

1. An apparatus for forming a truss assembly having a pair of spaced chords and a plurality of webs extending between the chords and connected thereto with connector portions, the apparatus comprising:

a frame;

first and second laterally spaced support rail means supported by said frame in generally parallel relation for receiving said chords and said webs for fabrication of the truss assembly;

means mounting said first and second support rail means for relative lateral movement with respect to each other; and means for effecting said relative lateral movement of said first and second support rail means, comprising means for moving one of said support rail means laterally of said frame to facilitate formation of truss assemblies of varying finished heights, and fluid pressure means for urging said one support rail means toward the other of said support rail means during formation of said truss assembly, said second support rail means being supported by said frame for lateral movement with respect thereto, said moving means comprising means for laterally moving said second support rail means, said apparatus including first and second pressure clamp means respectively mounted on said first and second support rail means for selective positioning longitudinally of said frame for applying clamping pressure to the connector portions of said truss assembly, said second clamp means being movable with said second support rail means laterally of said frame.

2. An apparatus for forming a truss assembly in accordance with claim 1, wherein each of said first and second support rail means comprises vertically movable platen means for coaction with said pressure clamp means for applying clamping pressure to the connector portions of said truss assembly.

3. An apparatus for forming a truss assembly in accordance with claim 1, wherein said means for moving said second support rail means comprises first screw thread means mounted on one of said frame and said second rail means, second screw thread means mounted on the other of said frame and second rail means, and means for relatively rotating said first and second screw thread means.

4. An apparatus for forming a truss assembly in accordance with claim 3, wherein said first screw thread means comprises a plurality of threaded shafts mounted on and extending laterally of said frame, and said second screw thread means comprises a plurality of threaded sleeves respectively mounted on said threaded shafts, with each of said sleeves mounted on said second support rail means, said means for relatively rotating comprising means for imparting concurrent rotation to said threaded shafts whereby said second support rail means is moved laterally of said frame.

5. An apparatus for forming a truss assembly in accordance with claim 4, wherein said fluid pressure means comprises fluid pressure means for urging said second support rail means toward said first support rail means during formation of said truss assembly, said fluid pressure means being operatively associated with each of said threaded sleeves whereby said second support rail means is shiftable laterally of said threaded sleeves.

6. An apparatus for forming a truss assembly including a pair of spaced chords and a plurality of truss webs extending between the chords and connected thereto with connector portions, the apparatus comprising a frame;

first and second laterally spaced support rail means supported by said frame in generally parallel relation for receiving said chords and said truss webs for fabrication of the truss assembly;

first and second pressure clamp means mounted on said frame for selective positioning longitudinally of said frame for applying clamping pressure to said connector portions;

means mounting said second support rail means for movement laterally of said frame, said second clamp means being movable laterally of said frame together with said second support rail means; and means for effecting movement of said second support rail means laterally of said frame comprising a plurality of spaced thread shafts mounted on and extending laterally of said frame, a plurality of threaded sleeves respectively mounted on said threaded shafts, with each said sleeve mounted on said second support rail means, and means for concurrently rotating said threaded shafts whereby said second support rail means is movable laterally of said frame to facilitate formation of truss assemblies of varying finished heights, said means for effecting movement of said second support rail means further comprising means for urging said second support rail means toward said first support rail means during formation of said truss assembly, including a plurality of fluid piston means respectively affixed to each of said threaded sleeves, and a plurality of fluid cylinder means mounted on said second support rail means within which said fluid piston means are respectively reciprocably disposed, whereby selective fluid pressurization of said cylinder means shifts said second support rail means laterally of said threaded sleeves for urging said second support rail means toward said first support rail means during formation of said truss assembly.

7. An apparatus for forming a truss assembly in accordance with claim 6, including link means interconnecting said first and second clamp means for movement thereof together longitudinally of said support rail means and said frame, said link means including linear bearing means whereby said second clamp means is movable with said second support rail means laterally of said frame.

8. An apparatus for forming a truss assembly in accordance with claim 6, including fluid pressure holding means selectively positionable on said first and second support rail means for holding the chords of said truss assembly in position on said support rail means.

9. An apparatus for forming a truss assembly in accordance with claim 6, including end jig means selectively positionable on said first and second support rail means for holding an endmost one of said truss webs in position for formation of said truss assembly.

10. An apparatus for forming a truss assembly in acccordance with claim 6, including web positioning jig means selectively positionable on said first and second support rail means for positioning the truss webs of said truss assembly.

11. An apparatus for forming a truss assembly in accordance with claim 10, wherein each of said first and second support rail means includes vertically movable platen means for coaction with said first and second pressure clamp means for applying clamping pressure to said connector portions.

12. An apparatus for forming a truss assembly including a pair of spaced chords and a plurality of truss webs extending between the chords and connected thereto with connector portions, the apparatus comprising a frame;

first and second laterally spaced support rail means supported by said frame in generally parallel relation for receiving said chords and said truss webs for fabrication of the truss assembly;

first and second pressure clamp means mounted on said frame for selective positioning longitudinally of said frame for applying clamping pressure to said connector portions;

means mounting said second support rail means for movement laterally of said frame, said second clamp means being movable laterally of said frame together with said second support rail means; and means for effecting movement of said second support rail means laterally of said frame, each of said first and second support rail means comprising a lower plate supported by said frame, a plurality of spaced L-shaped supports extending upwardly from said lower plate, a vertical inner plate affixed to the vertical legs of said L-shaped supports, and an upper plate affixed to the horizontal legs of said L-shaped supports above said lower plate, each of said support rail means further including vertically movable platen means positioned inwardly of and adjacent to the respective upper plate for coaction with respective one of said pressure clamp means.

13. An apparatus for forming a truss assembly in accordance with claim 12, wherein each of said support rail means further includes track means mounted on said lower plate for rollingly supporting a respective one of said first and second pressure clamp means.

14. An apparatus for forming a truss assembly in accordance with claim 12, including fluid pressure holding means selectively positionable on said first and second support rail means for holding the chords of said truss assembly in position on said support rail means.

15. An apparatus for forming a truss assembly in accordance with claim 12, including web positioning jig means selectively positionable on said first and second support rail means for positioning the truss webs of said truss assembly.

* * * * *

UNITED STATES PATENT AND TRADEMARK OFFICE

CERTIFICATE OF CORRECTION

PATENT NO. : 4,627,564

DATED : December 9, 1986

INVENTOR(S) : Donald M. Bowser

It is certified that error appears in the above-identified patent and that said Letters Patent is hereby corrected as shown below:

In the Abstract, line 1, "discussed" should read -- disclosed --.

Signed and Sealed this

Third Day of March, 1987

*Attest:*

*Attesting Officer*

DONALD J. QUIGG

*Commissioner of Patents and Trademarks*